United States Patent [19]

Frissora et al.

[11] Patent Number: 4,502,528

[45] Date of Patent: Mar. 5, 1985

[54] CHILLED CASTING WHEEL

[75] Inventors: Anthony P. Frissora, Mendham Township, Morris County; Alexander T. Kojak, Succasuna, both of N.J.

[73] Assignee: Allied Corporation, Morris Township, Morris County, N.J.

[21] Appl. No.: 481,555

[22] Filed: Apr. 4, 1983

[51] Int. Cl.[3] ..... B22D 11/06

[52] U.S. Cl. ..... 164/463; 164/485; 164/443; 164/348

[58] Field of Search ..... 164/463, 423, 427, 429, 164/479, 480, 428, 485, 443, 348, 448, 442; 165/89, 90

[56] References Cited

U.S. PATENT DOCUMENTS

| | | | |
|---|---|---|---|
| 3,454,077 | 7/1969 | Cofer et al. | 164/433 |
| 3,823,762 | 7/1974 | Wondris | 164/428 |
| 4,142,571 | 3/1979 | Narasimhan | 164/463 |
| 4,307,771 | 12/1981 | Draizen et al. | 164/463 |

*Primary Examiner*—Kuang Y. Lin
*Assistant Examiner*—Gerard M. Reid
*Attorney, Agent, or Firm*—Paul Yee; Ernest D. Buff; Gerhard H. Fuchs

[57] ABSTRACT

The method and apparatus of the invention provide a rotatable casting wheel having an outer peripheral quench surface and an interior, annular coolant chamber. A wheel hub has a concentric axis of rotation, and two spaced-apart, annular, radially extending side members connected thereto and located concentric therewith delimit the side walls of the wheel and the coolant chamber. A cylindrical, axially extending wheel rim member is connected between the peripheral circumferential edges of the side members to provide the wheel quench surface and delimit the peripheral, circumferential wall of the coolant chamber. The rim has a frustaconical inner surface that is sloped radially outward along the intended direction of coolant flow. A flow director located within the coolant chamber is comprised of at least one annular, radially extending support member and a cylindrical, axially extending flange member connected to the support member. The flange member is spaced radially inward from the inner surface of the wheel rim to delimit a sloped coolant flow gap therebetween which is substantially continuous, both circumferentially and axially. A coolant mechanism is connected to the wheel hub and communicates with the coolant chamber to pass a coolant through the flow gap while the wheel is rotating. Then, to cast a filament, an extrusion mechanism deposits molten metal onto the rotating quench surface.

11 Claims, 7 Drawing Figures

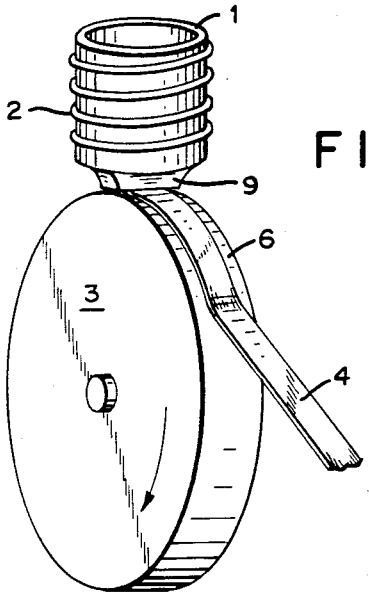
FIG. 1
FIG. 3
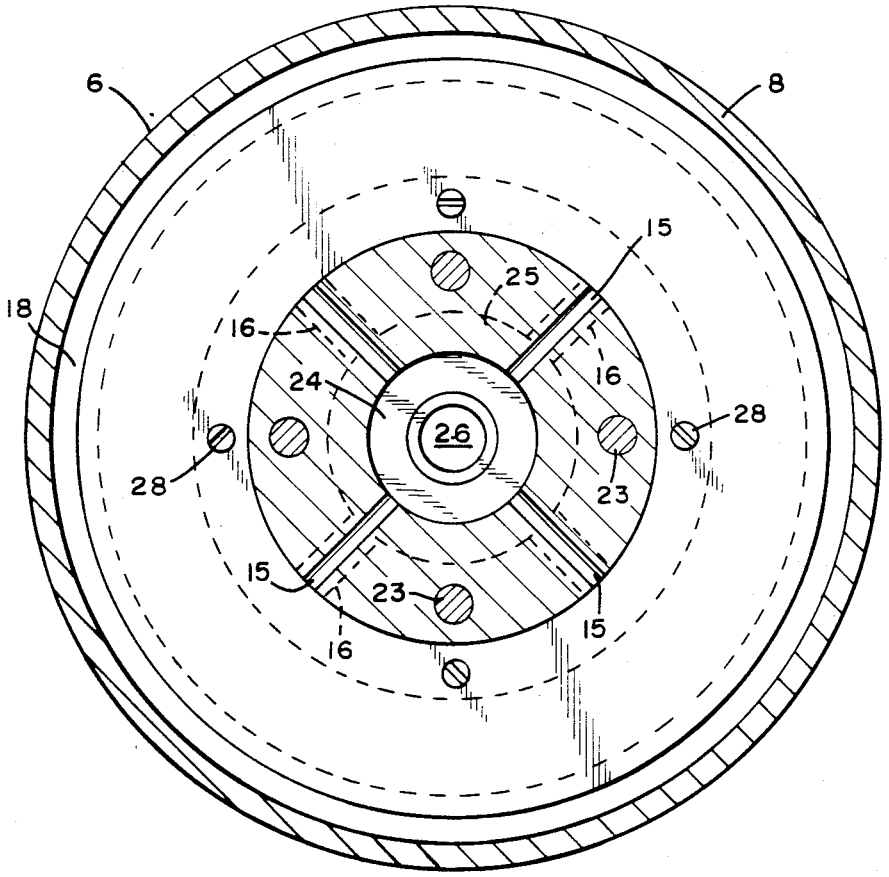

CHILLED CASTING WHEEL

DESCRIPTION

BACKGROUND OF THE INVENTION

1. Field of the Invention

This invention relates to a method and apparatus for rapid solidification of molten metal. More particularly, it relates to a casting wheel useful in the continuous casting of metallic filament.

2. Description of the Prior Art

In the production of glassy alloy continuous filaments, typically, an appropriate molten alloy is quenched at extreme quench rates, usually at least about $10^4$° C./sec. by extruding the molten alloy from a pressurized reservoir through an extrusion nozzle onto a high speed rotating quench surface as is representatively shown in U.S. Pat. No. 4,142,571 for "Continuous Casting Method for Metallic Strips" issued Mar. 6, 1978 to Narasimhan, hereby incorporated by reference. Such filaments are necessarily thin, typically about 25 to 100 microns, due to the extreme heat transfer rate required to prevent substantial crystallization, though considerable selectivity may be exercised respecting the transverse dimensions and cross-section of the filament.

Casting wheels of the prior art generally have been cooled by spraying a fluid, usually water, onto the inner surface of the wheel. However, such spray-cooled wheels do not provide sufficiently uniform cooling along the wheel quench surface. Casting wheels of the prior art have also been cooled by forcing a coolant to flow through separate discrete passages which are drilled axially through a portion of the wheel and located about the periphery of the casting wheel near the wheel quench surface. Such a casting wheel is representatively shown in U.S. Pat. No. 4,307,771 for "Forced-Convection-Cooled Casting Wheel" issued Dec. 29, 1981, to Draizen, et al., the disclosure of which is hereby incorporated by reference thereto. The casting wheel has an internal stiffening section which is particularly effective in preventing crowning-type distortions of the quench surface, which can be significant when casting relatively wide filaments of material. The casting wheel of Draizen, et al., however, is rather expensive, and impractical for use in casting narrow ribbons less than about 0.20 cm in width where crowning is generally not a problem. In addition, prior art casting wheels have no satisfactory means for adjusting the size of the cooling passages to accommodate different alloy compositions, and have undesireable circumferential temperature variations along the wheel quench surface caused by the presence of separate coolant passageways.

SUMMARY OF THE INVENTION

The apparatus of the invention provides an economical, rotatable casting wheel having an annular interior coolant chamber and a more uniformly cooled outer peripheral quench surface. The casting wheel includes a wheel hub having a concentric axis of rotation. Two spaced-apart, annular, radially extending side members are connected to the hub and located concentric therewith to delimit the side walls of the wheel and the coolant chamber. A cylindrical, axially extending wheel rim member connected between the peripheral, circumferential edges of the side members provides the wheel quench surface and delimits the peripheral circumferential wall of the coolant chamber. The rim has a frustaconical inner surface that is sloped radially outward along the intended direction of coolant flow. A flow director located within the coolant chamber is comprised of at least one annular, radially extending support portion, and a cylindrical, axially extending flange portion connected to the support member. The flange portion is spaced radially inward from and substantially parallel to the inner surface of the wheel rim to delimit a sloped flow gap therebetween which is substantially continuous, both circumferentially and axially. A coolant means connected to the wheel hub communicates with the coolant chamber to pass coolant through the flow gap while the wheel is rotating.

The invention further provides a method for continuously casting a metallic filament. A casting wheel, which has an interior coolant chamber and a wheel rim member that provides an outer peripheral quench surface, is rotated about a concentric axis of rotation. Coolant is directed toward an inner surface of said wheel rim and passed through a flow gap region to cool the quench surface. The flow gap region is substantially continuous, both circumferentially and axially, and is adjacent to the wheel rim inner surface. The flow gap region is also sloped radially outward along the intended direction of coolant flow to minimize the formation of gas bubbles against the rim. A stream of molten metal is then deposited onto the quench surface to cast the filament.

The casting wheel of the invention is less expensive to construct and has an improved flow control. The flow director, in cooperation with the sloped flow gap, provides a circumferentially continuous coolant passage, reduces the variations in heat transfer rate along the circumference of the wheel quench surface, and is easily modified to adjust the size of the coolant flow gap, thereby adapting the casting wheel to cast different allow compositions. Thus, the invention provides a more versatile, less expensive casting wheel having a more uniformly cooled quench surface than spray cooled wheels or wheels employing separated, discrete cooling passages.

BRIEF DESCRIPTION OF THE DRAWINGS

The invention will be more fully understood and further advantages will become apparent when reference is made to the following detailed description of the preferred embodiment of the invention and the accompanying drawings in which:

FIG. 1 is a perspective view of an apparatus for continuous casting of metallic filament;

FIG. 3 is a section taken along line A—A of FIG. 2;

DESCRIPTION OF THE PREFERRED EMBODIMENTS

Figure 2:
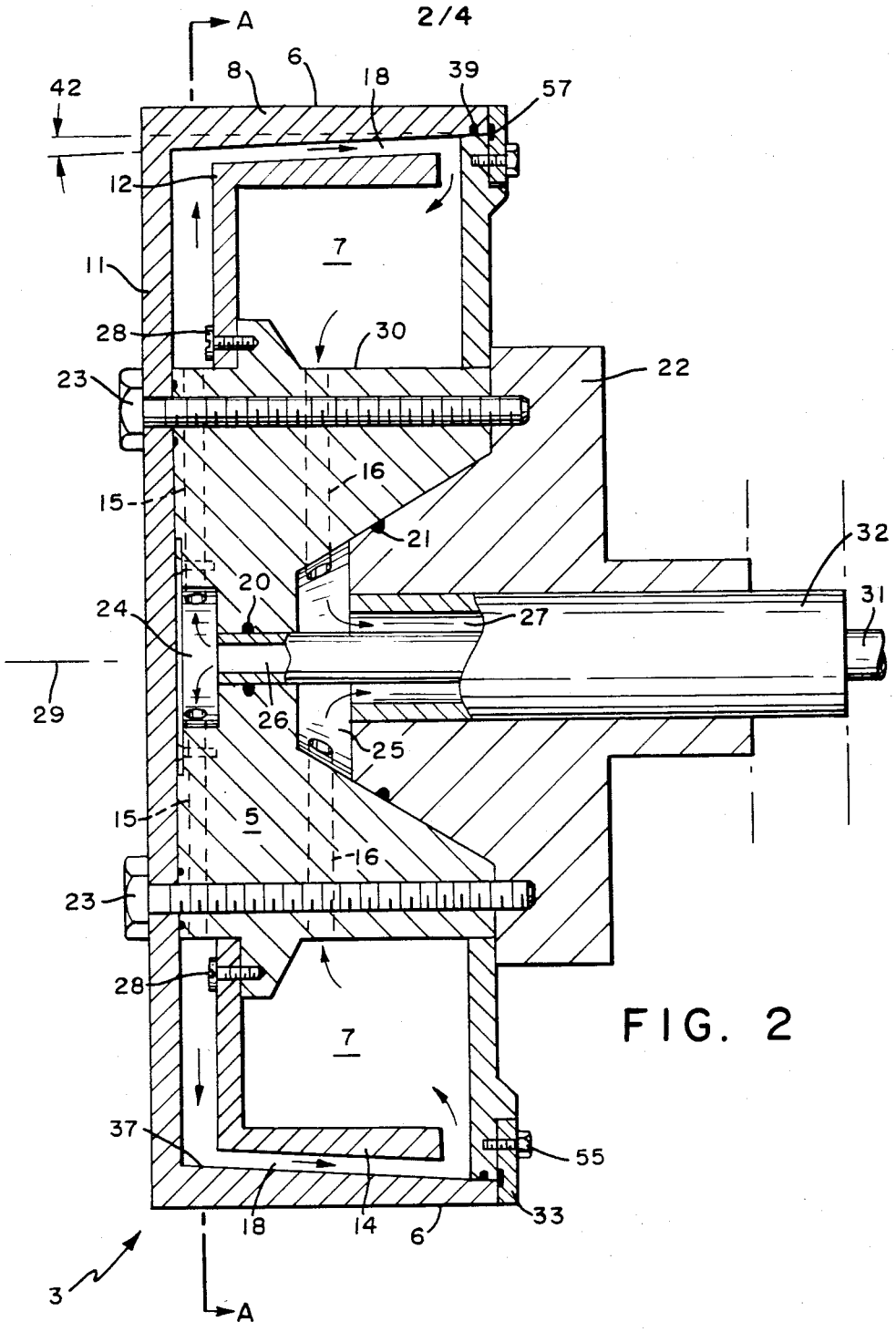
FIG. 2 is an axial cross-section of a casting wheel of the present invention.

For the purposes of the present invention and as used in the specification and claims, a wheel is a cylinder of substantially circular cross-section whose width (in the axial direction) is substantially smaller than its diameter. In contrast, a roller is generally understood to have a greater width than diameter.

Also, for the purposes of this invention and as used in the specification and claims, the term "filament" is a slender body whose transverse dimensions are much smaller than its length. Thus, the term "filament" includes wire, ribbon, sheet and the like, having regular or irregular cross-section.

Referring to FIG. 1 of the drawings, a representative apparatus for the continuous casting of a glassy alloy filament is illustrated to point out the general use of the present invention. The apparatus has an extrusion means comprising a crucible 1 and an extrusion nozzle 9. Molten alloy contained in crucible 1 is heated by a heating element 2, and pressurization of the crucible with an inert gas extrudes a molten stream through nozzle 9 located at the base of the crucible onto quench surface 6 of casting wheel 3.

The apparatus of this invention is suitable for forming polycrystalline strip of aluminum, tin, copper, iron, steel, stainless steel and the like. However, metal alloys that, upon rapid cooling from the melt, form solid amorphous, glassy structures are preferred. Such alloys are well known to those skilled in the art, and examples are disclosed in U.S. Pat. Nos. 3,427,154; 3,981,722 and others.

When forming amorphous alloys and certain crystalline metal alloys, quench rates of at least about $10^{4}$° C. are required to produce desired physical properties. The quench surface velocity, the composition and dimensions of the casting wheel, and the coolant flow rate through the wheel are sized and selected to provide this quench rate. For example, the casting wheel is rotated to provide a quench surface velocity ranging from about 100 to 4000 m/min, and preferably ranging from about 1000 to 2000 m/min.

FIGS. 2 and 3 illustrate a preferred embodiment of the rotatable casting wheel of the invention, shown generally at 3, which provides an outer peripheral quench surface 6 and an interior toroidal coolant chamber 7. A casting wheel hub 5 is adapted to mount on a suitable drive shaft and has a concentric axis of rotation. Two spaced-apart, annular, radially extending side members 10 and 11 connect to hub 5 and are concentric therewith to delimit the side walls of wheel 3 and coolant chamber 7. A cylindrical, axially extending wheel rim member 8 connects between the peripheral, circumferential edges of side members 10 and 11 to provide the wheel quench surface 6 and delimit the peripheral circumferential wall of coolant chamber 7. A flow director 12, located within coolant chamber 7, is comprised of at least one annular, radially extending support member 13 and a cylindrical, axially extending flange member 14. Flange member 14 is spaced radially inward from the interior surface of wheel rim 8 to delimit a circumferentially and axially continuous coolant flow gap 18. A coolant means, comprised of coolant passages 15 and 16 and coolant leader 17, connects to wheel 3 and communicates with coolant chamber 7 to pass a fluid coolant through coolant flow gap 18 while wheel 3 is rotating.

FIG. 2 shows a representative axial cross-section of rotatable casting wheel 3 adapted for cantilevered type mounting. Wheel hub 5 has a concentric axis of rotation 29 and delimits an inlet chamber 24 and outlet chamber 25. The back face of hub 5 has a tapered cavity disposed therein concentric with axis 29 that is adapted to mate with a correspondingly tapered shaft mounting plate 22 attached to drive shaft 19. The peripheral surface 30 of hub 5 delimits the inner peripheral wall of coolant chamber 7. An annular, radially extending side member 11 is connected to the front side of hub 5 and is concentric therewith. So connected, side member 11 delimits one side wall of chamber 7. An annular, radially extending side member 10 is connected to the back side of hub 5 and is concentric therewith; side member 10 delimits the second side wall of chamber 7. A cylindrical, axially extending wheel rim member 8 is connected between the peripheral circumferential edges of side members 10 and 11. Rim 8 provides the wheel quench surface 6 and delimits the outer peripheral wall of chamber 7. Thus, hub 5, side members 10 and 11, and rim 8 cooperate to form an annular coolant chamber 7.

While wheel 3 is described in terms of separate hub, side member and rim elements, it is clear that some or all of these elements may be formed together in various combinations as integral units. For example, rim 8 can be formed as an integral part of side member 11 and side plate 10 can be formed as an integral part of hub 5. In such case, rim 8 and side plate 10 are fastened together employing an annular clamp plate 33, screws 55 and suitable elastomeric seals 57 and 39 to prevent fluid leaks.

Wheel rim 8 should be sized and constructed to withstand the thermal and mechanical stresses encountered during casting operations. Suitable construction materials include stainless steel alloys, but copper alloys, such as beryllium-copper, are preferred because of their high thermal conductivity and corrosion resistance. Depending on the rim material, the thickness of the wheel rim measured radially ranges from about 0.31 cm to about 0.96 cm.

In addition, rim 8 is configured to have a tapered cross-section. The outer, quench surface extends parallel to the wheel rotational axis, but the inner surface 37 of the rim slopes radially outward along its axially extending, width dimension. As shown in the drawing, the slope progresses radially outward as one traverses the rim width in the direction of intended coolant flow, and preferably, there is a sloped incline 42 of about 1.5 degrees, measured relative to the wheel rotational axis. This incline provides the desired slope while minimizing the variation in rim thickness which could cause nonuniform quenching. Thusly configured, it is readily apparent that inner surface 37 of rim 8 delimits a frustaconical surface.

Flow director 12, located within coolant chamber 7, has at least one annular, radially extending support member 13 connected to hub 5 with suitable fastening means such as screws 28. A cylindrical, axially extending flange 14 is connected to support member 13. Thus, when viewing a cross-section of flow director 12, it has an "L" shaped appearance. Support member 13 is suitably sized and configured to position flange 14 substantially parallel to and spaced radially inward at a substantially constant distance from the interior surface of wheel rim 8. Preferred spacing distances range from about 0.038 cm to about 0.11 cm. So positioned, flange 14 and wheel rim 8 delimit a sloped coolant flow gap 18 therebetween which extends substantially continuous and uninterrupted in both the axial and circumferential directions.

Since flow gap 18 slopes radially outward along the direction of the coolant flow, the centripetal acceleration imparted by rotating wheel 3 produces an inertial reaction that assists the flow of coolant along the rim inner surface in the axial direction. Additionally, the sloped configuration advantageously minimizes the entrapment of gas bubbles against the inner surface of rim 8. Such bubbles would inhibit heat transfer from the rim into the fluid coolant and degrade the properties of the cast filament.

Since flow gap 18 is continuous and uninterrupted, it provides a more uniform cooling of wheel quench surface 6 than conventional cooled rollers and casting wheels with discrete axial passages. The quench surfaces of such rollers and casting wheels are cooler where a coolant passage runs directly under a quench surface and warmer where a wall section separates the individual coolant passages. Consequently, there is a nonuniform cooling of the extruded molten metal which can cause variations in the properties of the cast filament. In contrast to such devices, the casting wheel of the present invention allows substantially uniform coolant contact along the entire inside surface of wheel rim 8, and provides more uniform cooling of exterior quench surface 6.

Figure 5A:
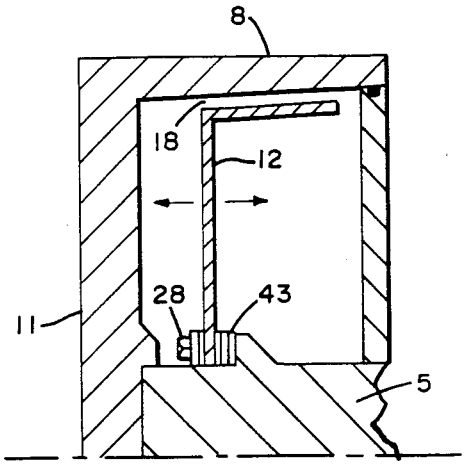
FIGS. 5 A–C show adjustment means for adjusting the wheel flow gap.
Figure 5C:
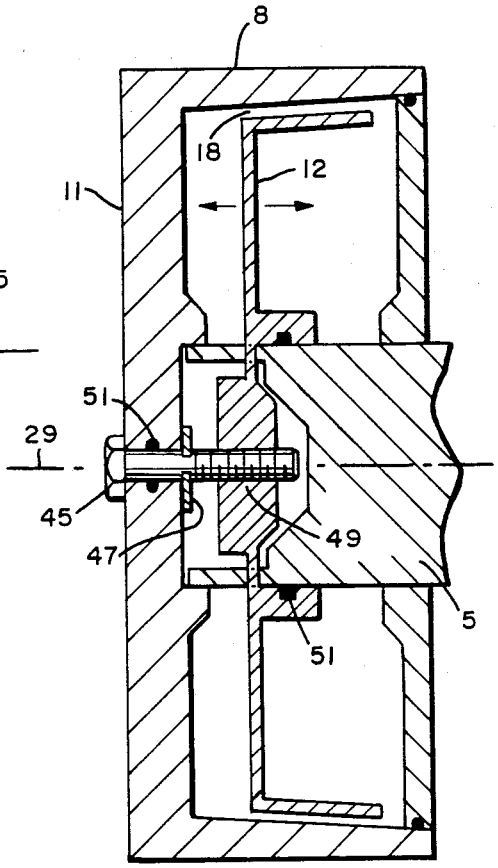
Figure 5B:
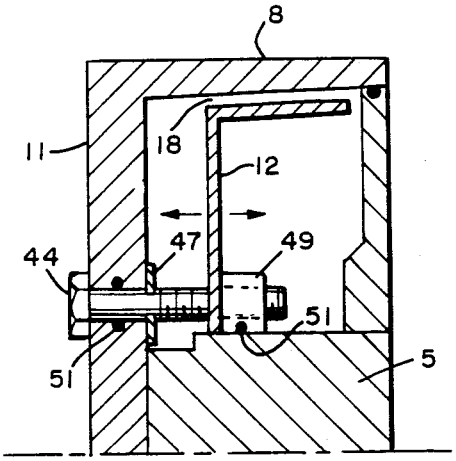

Also, with a sloped flow gap 18, flow director 12 can be readily modified or adjusted to change the flow gap as needed to accomodate the casting of a particular alloy composition. In the shown embodiment, flow director 12 can be removed by disengaging screws 28. A different flow director having an appropriately modified support member 13 or flange member 14 can then be substituted. For example, the radial dimension of support 13 can be changed to adjust the separation distance between flange 14 and the interior surface of rim 8. Alternatively, the assembly of support member 13 and flange member 14 can be configured to move axially. As representatively shown in FIGS. A–C adjustment means, such as internal spacer shims 43 or externally adjustable displacement screws 44 and 45, can be employed to move flow director 12 in a direction parallel to the rotational axis of wheel 3. In cooperation with the sloped and tapered configuration of rim 8, this movement selectively increases or decreases the spaced distance between rim 8 and flange 14, thereby adjusting the size of flow gap 18. FIG. 5B shows a multiple screw adjustment means wherein displacement screws 44 passes through wheel side member 11 and is retained therein by retainer 47. Screws 44 engages threaded block 49, which is attached to flow director 12. As screws 44 are turned, flow director 12 can selectively move axially along a bearing surface of hub 5 to adjust the size of gap 18. Seals 51 minimize leakage of coolant. FIG. 5C shows a single point external adjustment means where a single displacement screw 45 engages threaded block 49 to selectively move flow director 12. Casting wheels with discrete axial passages, however, are much more difficult to modify because such modification would involve changing a substantial part of the wheel structure.

A suitable fluid coolant, such as water, is provided by a coolant means connected to hub 5 and comprised of a coolant leader 17, plenum chambers 24 and 25 and passages 15 and 16. Coolant leader 17 is constructed of conventional co-axial fluid piping having an inner pipe casing 31 and an outer pipe casing 32. Inner casing 31 provides an inlet conduit 26, which conducts coolant from a suitable source, through hub 5 and into inlet plenum chamber 24. Inlet passages 15 formed through hub 5 communicate between inlet chamber 24 and coolant chamber 7. Outer casing 32 is radially spaced outward from inner casing 31 to delimit an annular outlet conduit 27 therebetween. Outlet conduit 27 communicates with outlet plenum chamber 25, and outlet passages 16 formed through hub 5 communicate between coolant chamber 7 and outlet chamber 25. Coolant leader 17 is connected to an appropriate source of coolant by a conventional rotating union. Suitable, fastening means, such as assembly bolts 23, secure wheel 3 to mounting plate 22; and sealing means, such as elastomeric "O" rings 20 and 21, are located as required to prevent fluid leaks.

During operation, wheel 3 is spun up to a desired rotational speed by a suitable drive means, such as a motor, connected to drive shaft 19. Coolant water is continuously pumped through conduit 26 into chamber 24, where it flows through passages 15 into coolant chamber 7. Flow direction 12 directs the water into flow gap 18 where it flows in a substantially axial direction contacting wheel rim 8 and cooling quench surface 6. Water flows out of coolant chamber 7 through passages 16 into outlet chamber 25 and then flows away from wheel 3 through conduit 27. When a suitable wheel temperature is established, nozzle 9 extrudes molten metal onto quench surface 6 to cast filament 4.

Figure 4:
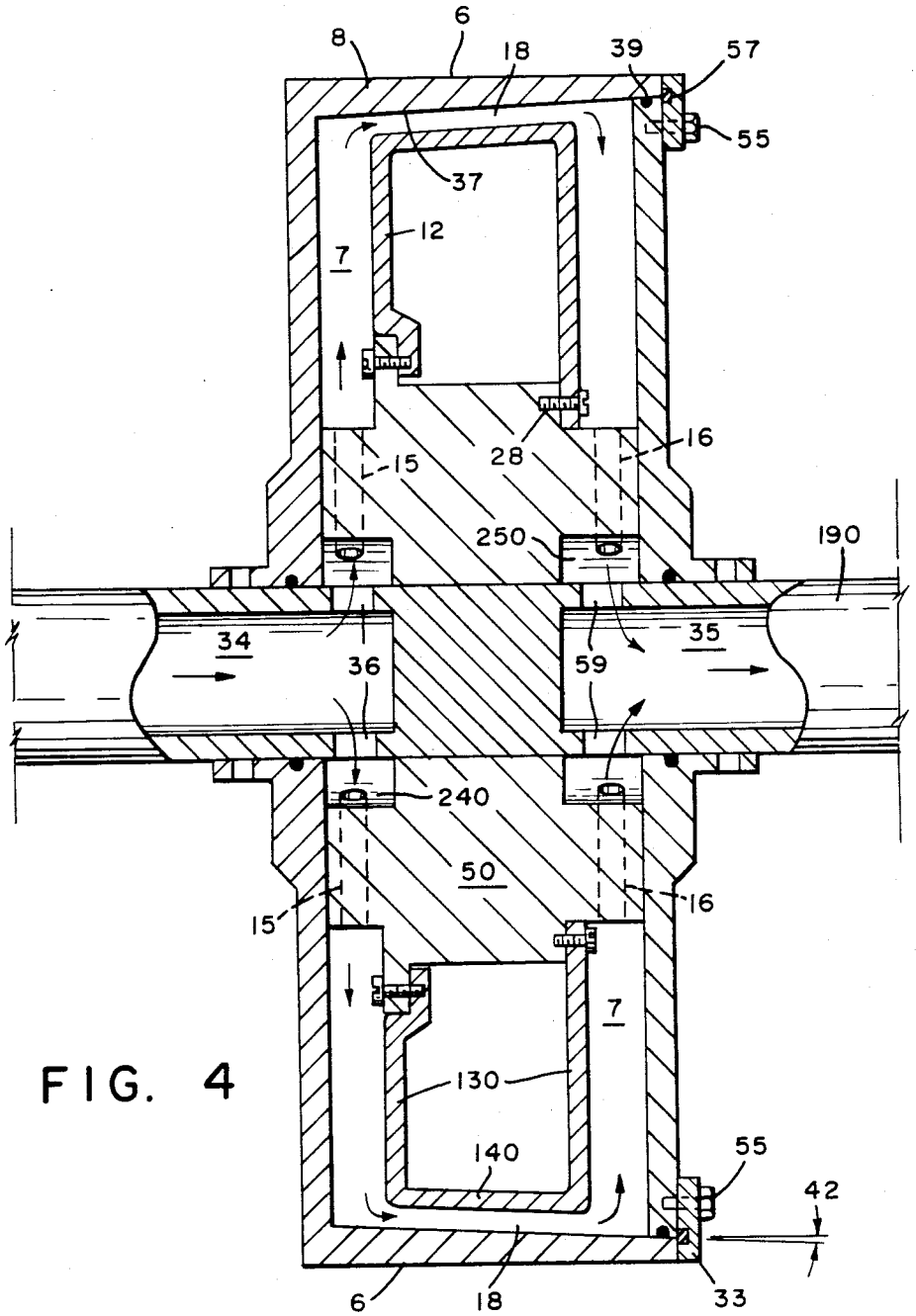
FIG. 4 is an axial cross-sectional view of a second embodiment of the invention.

FIG. 4 shows a second embodiment of the casting wheel of the invention employing "straight through" type coolant flow and incorporating a flow director with two support members. Hub 50, which has an axial bore adapted to engage and fit over drive shaft 190, delimits annular inlet chamber 240 and annular outlet chamber 250. Drive shaft 190 has axial cavities 35 and 34 that convey fluid to and from chambers 240 and 250. Cavity 34 communicates with chamber 240 through openings 36, and cavity 35 communicates with chamber 250 through openings 59.

Flow director 120 is comprised of two annular, radially extending support members 130; and a cylindrical, axially extending flange member 140 connected between the outer peripheral edges of support members 130. Flange member 140 is spaced radially inward from wheel rim 8 at a preselected distance to delimit a cooling flow gap 18 therebetween.

In operation, coolant enters cavity 34 and then passes through openings 36, chamber 240 and passages 15 to enter coolant chamber 7. Flow director 120 directs coolant into and through gap 18 where it contacts wheel rim 8 and cools quench surface 6. Coolant then flows out of coolant chamber 7 through passages 16, outlet chamber 250 and openings 37 and into cavity 35.

Having thus described the invention in rather full detail, it will be understood that these details need not be strictly adhered to but that various changes and modifications may suggest themselves to one skilled in the art, all falling within the scope of the invention as defined by the subjoined claims.

I claim:

1. A rotatable casting wheel having an outer peripheral quench surface and an interior, annular coolant chamber, comprising (a) a wheel hub having a concentric axis of rotation;

(b) two spaced-apart, annular, radially extending side members connected to said hub and located concentric therewith to delimit the side walls of said wheel and said coolant chamber;

(c) a cylindrical, axially extending wheel rim member connected between the peripheral, circumferential edges of said side members to provide said wheel quench surface and delimit the peripheral, circumferential wall of said coolant chamber, said rim having a frusta-conical inner surface that is sloped radially outward along the direction of coolant flow;

(d) a flow director located within said coolant chamber and comprised of at least one annular, radially extending support portion and an axially extending flange portion connected to said support portion; said flange portion being spaced radially inward from and substantially parallel to said rim inner surface to delimit a sloped coolant flow gap therebetween which is substantially continuous, both circumferentially and axially; and (e) coolant means connected to said wheel hub and in communication with said coolant chamber for passing a coolant through said coolant flow gap while said wheel is rotating.

2. A casting wheel as recited in claim 1, wherein said wheel rim has a thickness ranging from about 0.31 cm to about 0.96 cm.

3. A casting wheel as recited in claim 1, wherein said wheel rim is composed of a beryllium-copper alloy.

4. A casting wheel as recited in claim 1, wherein said wheel rim is composed of a stainless steel alloy.

5. A casting wheel as recited in claim 1, wherein said flow director flange portion is spaced radially inward from said wheel rim at a substantially constant distance ranging from about 0.038 cm to about 0.11 cm.

6. A casting wheel as recited in claim 1, wherein said flow director comprises:

(a) two radially extending support members connected to said hub; and (b) an axially extending flange member connected between the outer peripheral edges of said support members.

7. A casting wheel as recited in claim 1, further comprising adjustment means for moving said flow director to adjust said flow gap.

8. An apparatus for continuously casting metallic filament, comprising:

(a) a rotatable casting wheel having an outer peripheral quench surface and an interior, annular coolant chamber comprised of a wheel hub having a concentric axis of rotation two spaced-apart, annular, radially extending side members connected to said hub and located concentric therewith to delimit the side walls of said wheel and said coolant chamber, a cylindrical, axially extending wheel rim member connected between the peripheral, circumferential edges of said side members to provide said wheel quench surface and delimit the peripheral, circumferential wall of said coolant chamber, said rim having a frusta-conical inner surface that is sloped radially outward along the direction of coolant flow, a flow director located within said coolant chamber and comprised of at least one annular, radially extending support member connected to said hub and a cylindrical, axially extending flange member connected to said support member, said flange member having being spaced radially inward from and substantially parallel to said rim inner surface to delimit a sloped coolant flow gap therebetween which is substantially continuous, both circumferentially and axially;

(b) coolant means connected to said wheel hub and in communication with said coolant chamber for passing a coolant through said coolant flow gap while said wheel is rotating; and (c) extrusion means for depositing molten metal onto said quench surface.

9. A method for continuously casting a metallic filament on a casting wheel, comprising the steps of:

(a) rotating a casting wheel about a concentric axis of rotation, said wheel having an interior coolant chamber and a wheel rim member that provides an outer peripheral quench surface;

(b) directing coolant toward an inner surface of said wheel rim;

(c) passing coolant through a flow gap region, located between said rim inner surface and an axially extending flow director spaced radially inward therefrom, to cool said quench surface, said flow gap region being substantially continuous, both circumferentially and axially, and adjacent to said wheel rim inner surface;

(d) sloping said flow gap region radially outward along the direction of coolant flow to minimize the formation of gas bubbles along said rim member; and (e) depositing a stream of molten metal onto said quench surface to cast said filament.

10. A method as recited in claim 9, further comprising the step of sloping said flow gap region at an incline of about 1.5 degrees measured relative to said axis of rotation.

11. A method as recited in claim 9, further comprising the steps of:

(a) directing coolant toward an inner surface of said wheel rim with a radially extending flow director portion located within said coolant chamber; and (b) moving said flow director axially to adjust said flow gap region.

* * * * *